US011583740B2

(12) United States Patent
Hsu et al.

(10) Patent No.: US 11,583,740 B2
(45) Date of Patent: Feb. 21, 2023

(54) GOLF CLUB SHAFT AND METHOD OF MAKING THE SAME

(71) Applicant: PADERSON SPORTING GOODS CO., LTD., Taichung (TW)

(72) Inventors: Cheng-Ta Hsu, Taichung (TW); Jason Alan Horodezky, Taichung (TW)

(73) Assignee: PADERSON SPORTING GOODS CO., LTD., Taichung (TW)

( * ) Notice: Subject to any disclaimer, the term of this patent is extended or adjusted under 35 U.S.C. 154(b) by 0 days.

(21) Appl. No.: 17/227,723

(22) Filed: Apr. 12, 2021

(65) Prior Publication Data

US 2022/0193510 A1 Jun. 23, 2022

(30) Foreign Application Priority Data

Dec. 23, 2020 (TW) ..... 109145740

(51) Int. Cl.

| | |
|---|---|
| ***A63B 60/08*** | (2015.01) |
| ***A63B 60/24*** | (2015.01) |
| ***A63B 60/16*** | (2015.01) |
| ***A63B 102/32*** | (2015.01) |

(52) U.S. Cl.

CPC ..... *A63B 60/08* (2015.10); *A63B 60/24* (2015.10); *A63B 60/16* (2015.10); *A63B 2102/32* (2015.10); *A63B 2209/02* (2013.01)

(58) Field of Classification Search

CPC ..... A63B 60/08; A63B 60/00; A63B 53/10; F42B 6/04

See application file for complete search history.

(56) References Cited

U.S. PATENT DOCUMENTS

| | | | | |
|---|---|---|---|---|
| 5,943,758 | A * | 8/1999 | Haas | A63B 53/10 29/516 |
| 2003/0079839 | A1* | 5/2003 | Fenton, Jr. | A63B 60/00 156/425 |
| 2003/0157990 | A1* | 8/2003 | Bloom, Jr. | A63B 60/00 473/297 |
| 2018/0003470 | A1* | 1/2018 | Greenwood | F42B 6/04 |

FOREIGN PATENT DOCUMENTS

| | | |
|---|---|---|
| TW | M294961 U | 8/2006 |

* cited by examiner

*Primary Examiner* — Eugene L Kim
*Assistant Examiner* — Christopher Glenn
(74) *Attorney, Agent, or Firm* — Muncy, Geissler, Olds & Lowe, P.C.

(57) ABSTRACT

A golf club shaft includes a shaft body having a butt end and a tip end, and a counterweight member on an outer periphery of the shaft body between the butt and tip ends. The counterweight member is made of a fiber composite material configured in a way that the counterweight member has a color visually distinguishable from that of the shaft body.

4 Claims, 8 Drawing Sheets

GOLF CLUB SHAFT AND METHOD OF MAKING THE SAME

BACKGROUND OF THE INVENTION

1. Technical Field

The present invention relates to a golf club and more particularly, to a golf club shaft and a method of making the same.

2. Description of Related Art

Clubs that contain a carbon fiber material (e.g., carbon fiber-containing golf clubs) are in extensive use today. These clubs can hit balls better than those made of other materials because their body possesses the flexibility, rigidity, torsional properties, center of gravity, and weight distribution typical of a carbon fiber material. Taiwan Utility Model Patent No. M294961U, for example, discloses "Golf Club Shaft with Hidden Counterweight Structure". As described and shown in the specification and drawings of the Taiwan patent, the shaft 10 (the reference numerals used in this and the next paragraph are those originally used for the embodiments of the patented utility model) is formed by winding a resin-impregnated fiber strip and includes a carbon fiber counterweight structure 14 formed by winding a carbon fiber material around the inner layer 13 of the resin-impregnated fiber strip. The counterweight structure 14 has an overall length set between 10 mm and 50 mm and a weight set between 1 g and 2 g. The location of the counterweight structure 14 is between a point 100 mm away from the tip end 11 of the shaft 10 and a point 250 mm away from the butt end 12 of the shaft 10. The technical feature of the patented utility model lies in that the carbon fiber counterweight structure 14 is formed on a specific portion of the inner layer 13 of the shaft 10, thereby allowing the moving speed of the tip end 11 of the shaft 10 to keep up with that of the remainder of the shaft 10 when the shaft 10 is swung so as to prevent the ball being hit from shifting outward.

The "Golf Club Shaft with Hidden Counterweight Structure" disclosed in the aforesaid patent, however, still has room for improvement. More specifically, because the technical feature of the patented utility model lies in that the counterweight structure 14 of the shaft 10 is formed by winding a carbon fiber material around a specific portion of the inner layer 13 of the shaft 10, there will be the following problem. When a user is trying to choose a golf club suitable for himself/herself in a set of golf clubs (for example, a golf club with the counterweight structure 14 relatively close to the tip end 11 of the shaft 10 such that the golf club may have a counterweight ratio similar to that of a 9-iron, 10-iron (PW), or 11-iron (F or A), or a golf club with the counterweight structure 14 relatively close to the butt end 12 of the shaft 10 such that the golf club may have a counterweight ratio similar to that of a 1-iron, 2-iron, 3-iron, 4-iron, or 5-iron), the fact that the counterweight structure 14 is provided inside the shaft 10 and thus invisible to the user makes it impossible for the user to clearly identify the location of the counterweight structure 14 immediately, which adds to the difficulty of choosing the right golf club.

SUMMARY OF THE INVENTION

The present invention has been accomplished in view of the above-noted circumstances. It is an objective of the present invention to provide a golf club shaft, which has a counterweight member that can be easily and visually identified by a user.

To achieve the foregoing objective, the present invention provides a golf club shaft comprising a shaft body with a butt end and a tip end, and a counterweight member covering an outer periphery of the shaft body between the butt and tip ends. The counterweight member is made of a fiber composite material configured in the way that the counterweight member has a color different from that of the shaft body, such that the counterweight member is easily and visually identifiable to a user.

Preferably, the counterweight member of the golf club shaft is formed by winding a carbon fiber composite material and a platinum-containing composite material with a predetermined included angle therebetween; or by winding a carbon fiber composite material and a Kevlar fiber composite material with a predetermined included angle therebetween; or by winding a carbon fiber composite material and an electroplated glass fiber composite material with a predetermined included angle therebetween; or by laminating two or more layers of 3K carbon fiber woven cloth.

The present invention further provides a method of making a golf club shaft comprising the following steps of: winding a carbon fiber composite material around a shaft-forming mold at a predetermined included angle therebetween to form a raw shaft body having a butt end and a tip end; winding a fiber composite material around the raw shaft body to form a counterweight member; covering scrim layer on an outer surface of a tip end portion of the raw shaft body; placing the raw shaft body carrying the counterweight member in a shrink-wrapping machine and enveloping the raw shaft body and the counterweight member in a shrink wrap; and placing the raw shaft body carrying the counterweight member, which are enveloped in the shrink wrap, in a forming machine at a predetermined temperature such that the raw shaft body and the counterweight member are compressed by the shrink wrap to produce a formed shaft body carrying the counterweight member.

Preferably, the predetermined temperature of the forming machine is set between 130° C. and 200° C., such that a gap between the raw shaft body and the counterweight member is compressed by the shrink wrap to a range between 0.5 mm and 2.0 mm.

Preferably, the method further comprises a step of placing the formed shaft body carrying the counterweight member in a vacuum machine at a predetermined vacuum level and a predetermined operating temperature to firmly bond the counterweight member on the formed shaft body.

DETAILED DESCRIPTION OF THE INVENTION

Figure 1:
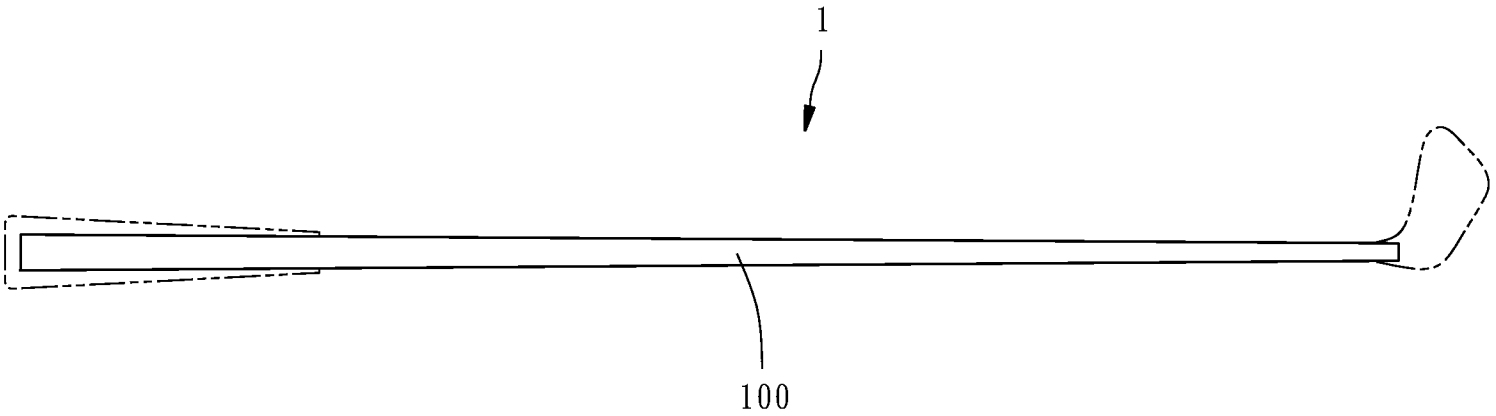
FIG. 1 is a schematic lateral view of a golf club shaft according to a preferred embodiment of the present invention.

To begin with, the applicant wishes to point out that throughout this specification (including the description of the embodiment disclosed below) and the appended claims, all directional terms make reference to the directions presented in the accompanying drawings. In addition, identical or similar elements or structural features in the following embodiment and the drawings are indicated by the same reference numeral.

Figure 2:
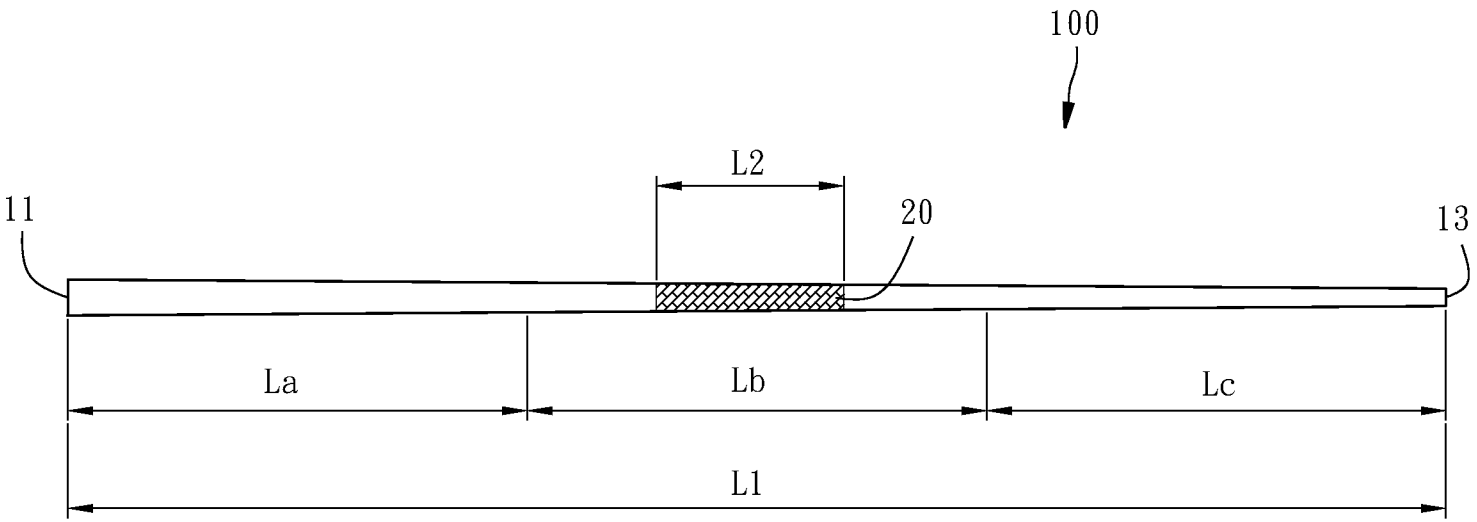
FIG. 2 is a schematic, partial enlarged view of FIG. 1.

Referring to FIG. 1 and FIG. 2, a golf club shaft 1 provided by a preferred embodiment of the present invention includes a shaft body 100 and a counterweight member 20. The shaft body 100 has a large-diameter end (hereinafter referred to as the butt end) 11 and a small-diameter end (hereinafter referred to as the tip end) 13. A predetermined portion of the shaft body 100 that lies between the butt end 11 and the tip end 13 is circumferentially provided with a counterweight member 20. The shaft body 100 is formed by the following processes. A shaft-forming mold is covered with a strip of carbon fiber composite material in a way that the strip is wound around the shaft-forming mold at a predetermined included angle therebetween to form a shaft body 100 having a butt end 11 and a tip end 13, and then the formed shaft body 100 is removed from the shaft-forming mold. The strip of the carbon fiber composite material may be, but not limited to, a woven, e.g., plain-woven, or interlaced strip. The aforesaid predetermined included angle in this embodiment may be, but not limited to, 0, 45, 60, 75, or 90 degrees. The aforesaid method of making the shaft body 100 by using the shaft-forming mold and the strip of carbon fiber composite material is well known in the art, and therefore will not be detailedly described hereinafter. The counterweight member 20 is formed by laminating two or more layers, e.g., two to five layers, of 3K carbon fiber woven cloth over a predetermined portion of the shaft body 100. In another embodiment, the counterweight member 20 may be formed by winding around the shaft body 100 a strip of carbon fiber composite material and a strip of platinum-containing composite material at a predetermined included angle therebetween. In still another embodiment, the counterweight member 20 may be formed by winding around the shaft body 100 a strip of carbon fiber composite material and a strip of Kevlar fiber composite material at a predetermined included angle therebetween. In still another embodiment, the counterweight member 20 may be formed by winding around the shaft body 100 a strip of carbon fiber composite material and a strip of electroplated glass fiber composite material at a predetermined included angle therebetween. The aforesaid strip of the carbon fiber composite material, the platinum-containing composite material, Kevlar fiber composite material or electroplated glass fiber composite material may be, but not limited to, a woven, e.g., plain-woven, or interlaced strip. The aforesaid predetermined included angle may be, but not limited to, 0, 45, 60, 75, or 90 degrees. For the platinum-containing composite material, a gold-platinum alloy or aluminum-platinum alloy composite material may, but not limited to, be used. With the aforesaid forming method and material composition, the counterweight member 20 has a structural configuration and a color different from those of the shaft body 100, such that the counterweigh member 20 is visually distinguishable over the shaft body 100.

As shown in FIG. 2, the total length of the shaft body 100 is defined as L1, and the total length of the counterweight member 20 is defined as L2. The length ratio of the shaft body 100 to the counterweight member 20, which is represented as L1:L2, is 10-12:1. In this embodiment, the total length L2 of the counterweight member 20 is about 100 mm by way of example, and the total length L1 of the shaft body 100 is approximately between 1000 mm and 1200 mm by way of example. Moreover, the shaft body 100 is divided into a first section La, a second section Lb, and a third section Lc, which are sequentially arranged from the butt end 11 toward the tip end 13 of the shaft body 100 and are of the same length, meaning each section La, Lb, or Lc has a total length ranging approximately from 333 mm to 400 mm. The counterweight member 20 may be provided on the first section La, the second section Lb, or the third section Lc of the shaft 100, depending on practical needs.

With the above-described structural and material features, the golf club shaft 1 of the present invention has the following advantages.

1. Because the counterweight member 20 comprises 3K carbon fiber woven cloth, platinum-containing composite material, Kevlar fiber composite material, or electroplated glass fiber composite material, the counterweight member 20 will have a color different from that of the shaft body 100. As a result, a user can easily and visually identify the location of the counterweight member 20 on the shaft body 100.

2. As the length ratio of the shaft body 100 to the counterweight member 20 (hereunder referred to as "L1:L2") is 10-12:1, a user can clearly identify the counterweight member 200 on a specific location of the shaft body 100. If the total length of the counterweight member 20 is less than 100 mm or the length ratio L1:L2 is set as 13-17:1, the difficulty for a user to clearly identify the counterweigh member 200 on the shaft body 100 will greatly increase due to the grounds that the length ratio of the counterweight member 20 to the shaft body 100 is too small even though the counterweight member 20 has a color visually distinguishable over that of the shaft body 100. In another aspect, if the total length of the counterweight member 20 is far greater than 100 mm or the length ratio L1:L2 is set as 5-9:1, a user may feel confused upon selection, i.e. the user may misrecognize the counterweight member 20 as brand, advertising symbol, deco device, etc., due to the grounds that the length ratio of the counterweight member 20 to the shaft body 100 is too large even though the counterweight member 20 has a color visually distinguishable over that of the shaft body 100. As a result, the length ratio L1:L2 is preferably set as 10-12:1 for getting a clear, unambiguous identification effect of the counterweight member 20 on the shaft body 100, thereby facilitating selection without any confusion to the user.

3. With the structural feature that the counterweight member 20 is provided on a predetermined portion (namely the first section La, the second section Lb, or the third section Lc) of the shaft body 100, a user can immediately and clearly identify the predetermined counterweight ratio defined by the location of the counterweight member 20 on the shaft body 100 and can therefore easily choose a suitable golf club from a plurality of golf clubs with different counterweight ratios. In terms of wooden golf clubs for example, locating the counterweight member 20 on the first section La of the shaft body 100 produces a counterweight ratio similar to the predetermined counterweight ratio of a 1-driver wood or of a 1-, 2-, or 3-fairway wood; locating the counterweight member 20 on the second section Lb of the shaft body 100 produces a counterweight ratio similar to the predetermined counterweight ratio of a 4-, 5-, or 6-fairway wood; and locating the counterweight member 20 on the third section Lc of the shaft body 100 produces a counterweight ratio similar to the predetermined counterweight ratio of a 7-, 8-, or 9-fairway wood. In terms of iron golf clubs for another example, locating the counterweight member 20 on the first section La of the shaft body 100 produces a counterweight ratio similar to the predetermined counterweight ratio of a 1-, 2-, 3-, 4-, or 5-iron; locating the counterweight member 20 on the second section Lb of the shaft body 100 produces a counterweight ratio similar to the predetermined counterweight ratio of a 6-, 7-, or 8-iron; and locating the counterweight member 20 on the third section Lc of the shaft body 100 produces a counterweight ratio similar to the predetermined counterweight ratio of a 9-iron, 10-iron (PW), or 11-iron (F or A). If the shaft body 100 is equidistantly divided from the butt end 11 toward the tip end 13 into more than three sections, e.g., four to six sections, the difficulty of section to a user may increase because it will be more difficult for the user to recognize about whether a specific section carrying the counterweight member 20 will correspond to which type of counterweight ratio of a golf club due to the grounds that the division is too fine. In another aspect, if the shaft body 100 is equidistantly divided from the butt end 11 toward the tip end 13 into two sections only, a user may be not able to recognize about whether a specific section carrying the counterweight member 20 will correspond to which type of counterweight ratio of a golf club due to the grounds that the division is too rough. As a result, the counterweight member 20 is preferably provided on one of the three evenly-divided three sections La, Lb and Lc for enabling the user to recognize the corresponding relationship between the location of the counterweight member 20 and the type of counterweight ratio of a golf club without causing selection confusion to the user.

A method of making a golf club shaft 1 having the shaft body 100 and the counterweight member 20 of the preferred embodiment of the present invention will be illustrated hereunder. Specifically, the method comprises the following steps.

Figure 3:
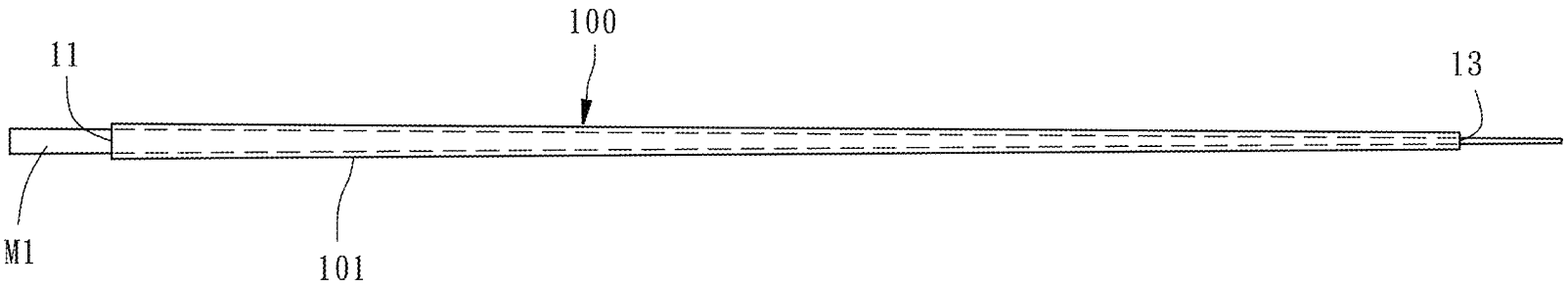
FIG. 3 is a schematic view of step a) of a method of making a golf club shaft of the preferred embodiment of the present invention.

Step a): Referring to FIG. 3, a shaft-forming mold M1 is covered with a carbon fiber composite material 101 in order to form a raw shaft body 100 of a predetermined dimension. More specifically, a strip of carbon fiber composite material 101 is wound around the shaft-forming mold M1 at a predetermined included angle therebetween to form the raw shaft body 100 having a butt end 11 and a tip end 13. In this preferred embodiment, the strip of the carbon fiber composite material 101 may be, but not limited to, a woven, e.g., plain-woven, or interlaced strip. The aforesaid predetermined included angle may be, but not limited to, 0, 45, 60, 75, or 90 degrees.

Figure 4:
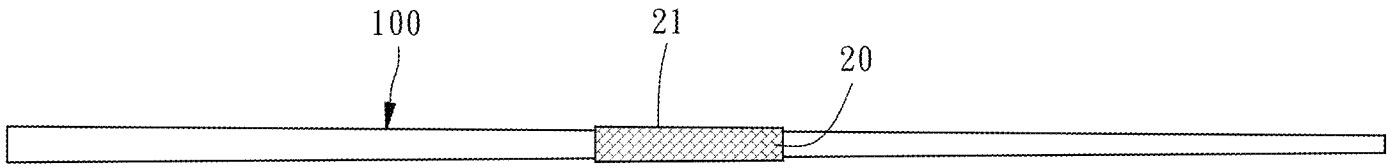
FIG. 4 is a schematic view of step b) of the method of making a golf club shaft of the preferred embodiment of the present invention.

Step b): Referring to FIG. 4, a predetermined portion of the raw shaft body 100 is covered with a fiber composite material 21, e.g., two or more layers of 3K carbon fiber woven cloth to form a counterweight member 20. In another embodiment, the counterweight member 20 may be formed by winding around the raw shaft body 100 a strip of carbon fiber composite material and a strip of platinum-containing composite material, or a strip of carbon fiber composite material and a strip of Kevlar fiber composite material, or a strip of carbon fiber composite material and a strip of electroplated glass fiber composite material, at a predetermined included angle therebetween. The strip of the carbon fiber composite material, the platinum-containing composite material, Kevlar fiber composite material or electroplated glass fiber composite material may be, but not limited to, a woven, e.g., plain-woven, or interlaced strip. The aforesaid predetermined included angle may be, but not limited to, 0, 45, 60, 75, or 90 degrees. For the platinum-containing composite material, a gold-platinum alloy or aluminum-platinum alloy composite material may, but not limited to, be used.

Figure 5:
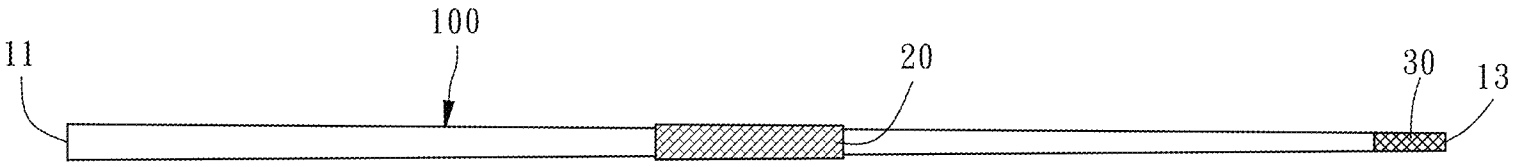
FIG. 5 is a schematic view of step c) of the method of making a golf club shaft of the preferred embodiment of the present invention.

Step c): Referring to FIG. 5, the outer surface of a tip end portion of the raw shaft body 100 is covered with a scrim layer 30 (e.g., a glass fiber layer) to reinforce the tip end portion as a preparation before a golf club head is mounted on the golf club shaft 1. The length over which the raw shaft body 100 is covered with the scrim layer 30 extends for 20 mm to 50 mm from the tip end 13 toward the butt end 11.

Figure 6:
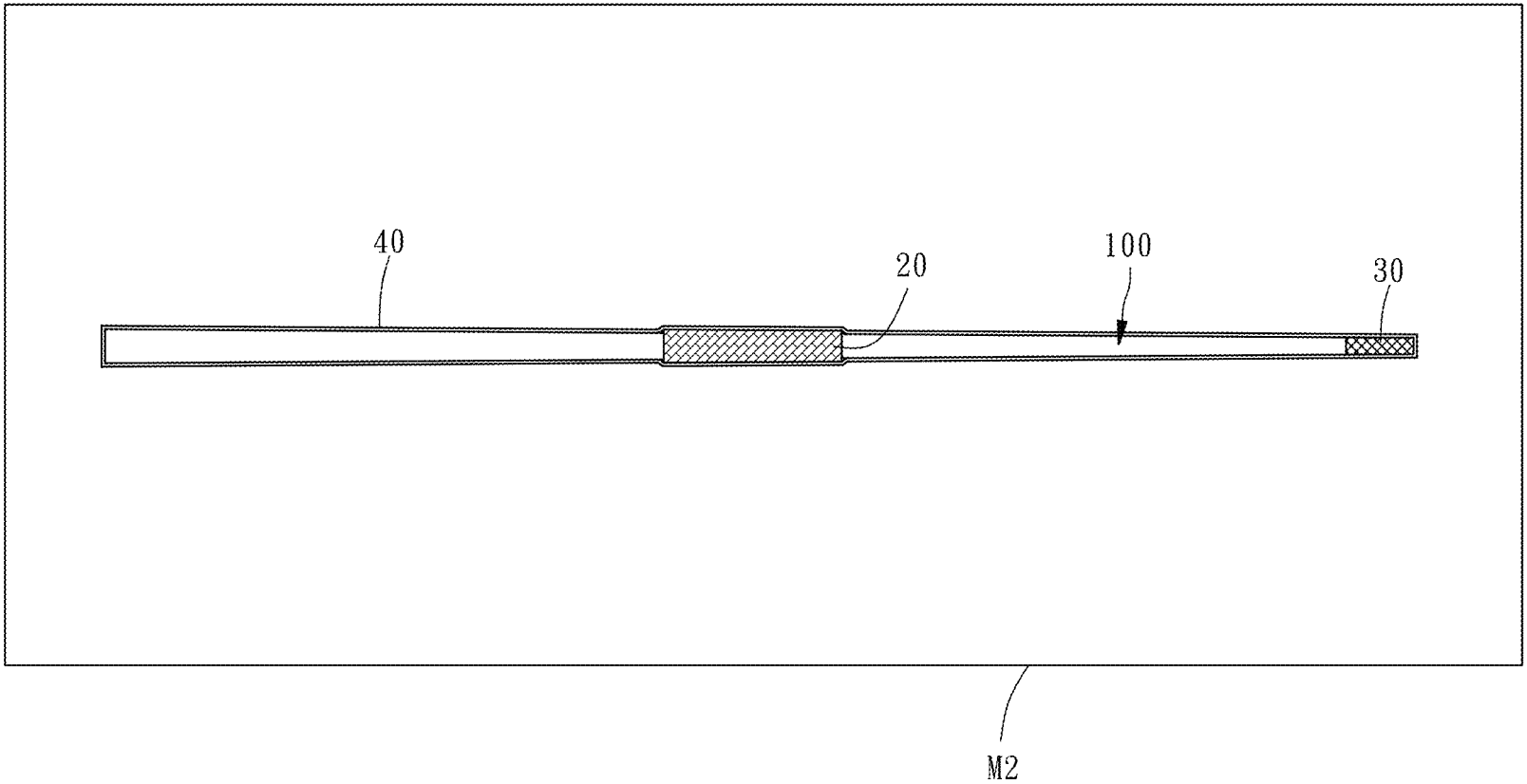
FIG. 6 is a schematic view of step d) of the method of making a golf club shaft of the preferred embodiment of the present invention.

Step d): Referring to FIG. 6, the raw shaft body 100, on which the counterweight member 20 is formed, is placed in a shrink-wrapping machine M2, such that the raw shaft body 100 and the counterweight member 20 are enveloped in a shrink wrap 40 while the shrink-wrapping machine M2 is at room temperature. For the shrink wrap 40 in this step, a biaxially oriented polypropylene (BOPP) film may, but not limited to, be used.

Figure 7:
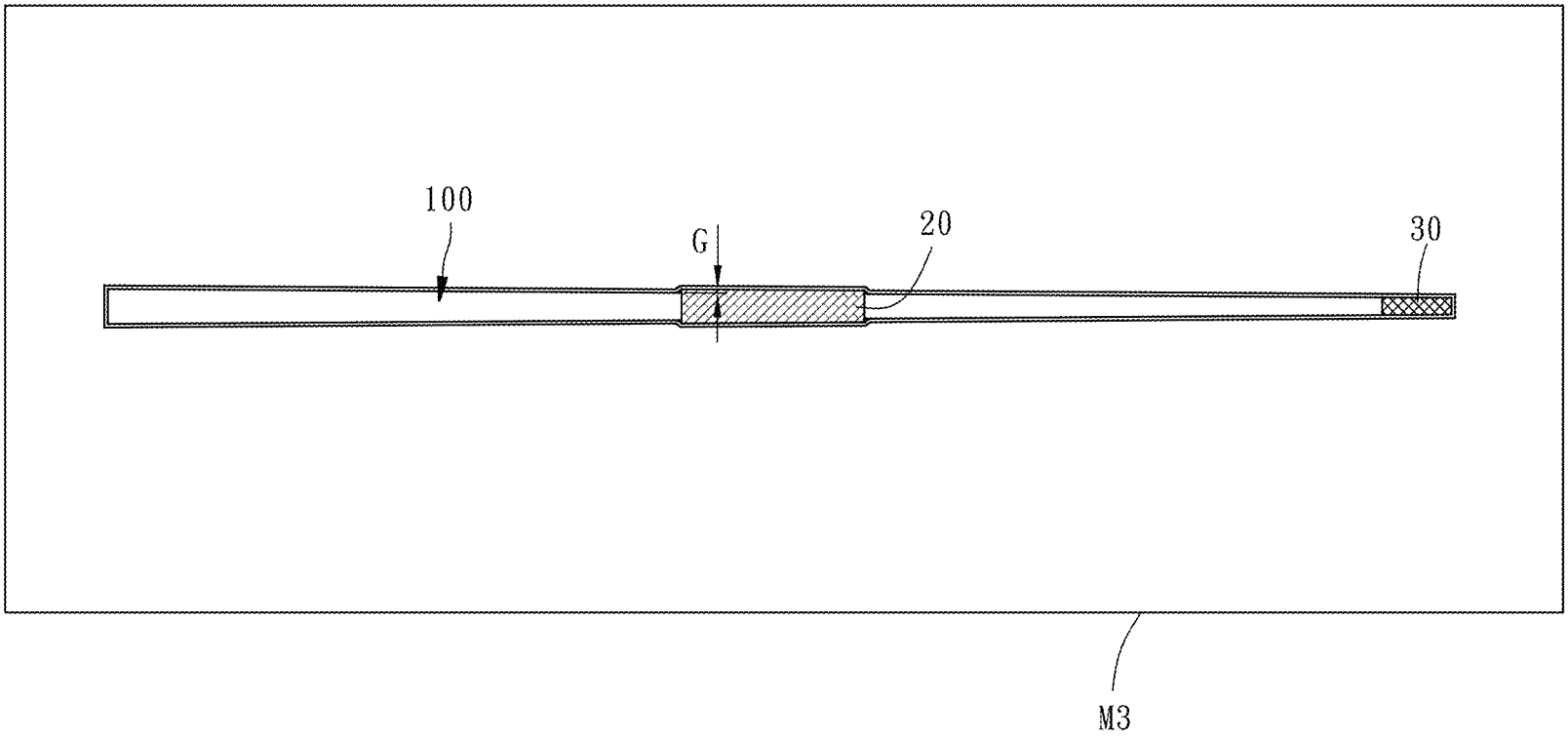
FIG. 7 is a schematic view of step e) of the method of making a golf club shaft of the preferred embodiment of the present invention.

Step e): Referring to FIG. 7, the shrink wrap-enclosed raw shaft body 100 is placed in a forming machine M3, and then heated at a predetermined forming temperature so that the space between the raw shaft body 100 and the counterweight member 20 can be compressed by the shrink wrap 40 and reduced to a predetermined gap G to produce a shrink-formed shaft body 100 carrying the counterweight member 20. In this step, the predetermined forming temperature at which the forming machine is set is between 130° C. and 200° C., and the predetermined gap G to which the space between the raw shaft body 100 and the counterweight member 20 is reduced by the shrink wrap 40 is approximately between 0.5 mm and 2.0 mm. It is worth mentioning that this step may be divided into a prebaking stage and a forming stage. In the prebaking stage, the forming machine M3 is set at a temperature between 70° C. and 90° C. as the prebaking temperature, and the operation time is set between 30 min and 40 min. In the forming stage that follows, the forming machine M3 is set at a temperature between 130° C. and 220° C. as the forming temperature, and the operation time is set between 80 min and 90 min.

Figure 8:
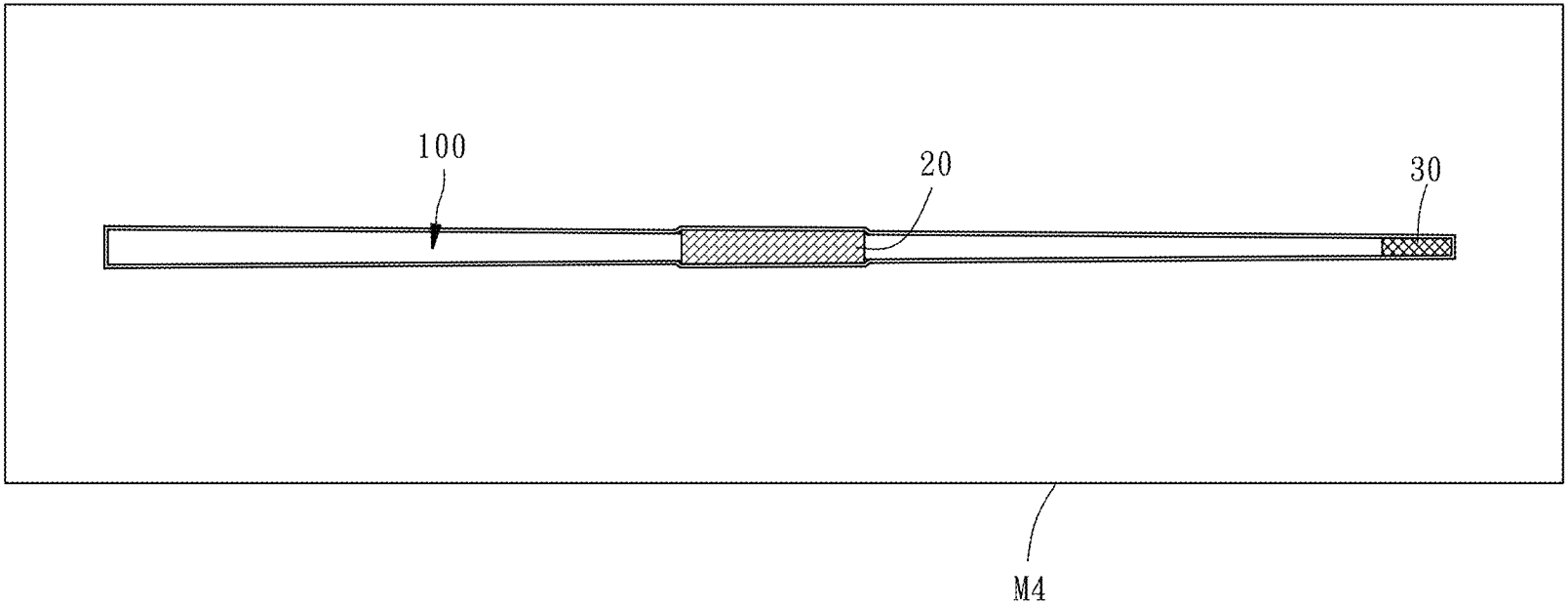
FIG. 8 is a schematic view of step f) of the method of making a golf club shaft of the preferred embodiment of the present invention.

Step f): Referring to FIG. 8, the shrink-formed shaft body 100 carrying the counterweight member 20 is placed in a vacuum machine M4, and the vacuum machine M4 is set at a predetermined vacuum level and a predetermined operating temperature in order to tightly bond the counterweight member 20 and the shaft body 100 together. In this step, the predetermined vacuum level at which the vacuum machine is set is between −1.0 atm and −3.0 atm, and the predetermined operating temperature at which the vacuum machine is set is between 130° C. and 150° C.

Step g): Burrs of the formed shaft body 100 are trimmed off, and the formed shaft body 100 is removed from the shaft-forming machine.

While the structural details, features, method of assembly or use, and manufacturing method of the present invention have been detailedly described above with reference to a preferred embodiment, a person of ordinary skill in the art would understood that the foregoing detailed description and the specific embodiment provided herein serve only to expound the invention but not to restrict the scope of the invention.

What is claimed is:

1. A method of making a golf club shaft, comprising the steps of:

a) covering a shaft-forming mold with a carbon fiber composite material by winding the carbon fiber composite material around the shaft-forming mold at a predetermined included angle therebetween to form a raw shaft body having a butt end and a tip end;

b) winding a fiber composite material around the raw shaft body to form a counterweight member on the raw shaft body;

c) covering a scrim layer on an outer surface of a tip end portion of the raw shaft body;

d) placing the raw shaft body carrying the counterweight member in a shrink-wrapping machine and enveloping the raw shaft body and the counterweight member in a shrink wrap; and e) placing the raw shaft body carrying the counterweight member, which are enveloped in the shrink wrap, in a forming machine at a predetermined temperature such that the raw shaft body and the counterweight member are compressed by the shrink wrap to reduce a space between the raw shaft body and the counterweight member to a predetermined gap, thereby producing a formed shaft body carrying the counterweight member.

2. The method of making the golf club shaft as claimed in claim 1, wherein the fiber composite material of the counterweight member comprises one selected from a group consisting of a composite material of a carbon fiber composite material and a platinum-containing composite material, a composite material of a carbon fiber composite material and a Kevlar fiber composite material, a composite material of a carbon fiber composite material and an electroplated glass fiber composite material, and at least two laminated layers of 3K carbon fiber woven cloth.

3. The method of making the golf club shaft as claimed in claim 2, wherein in the step e), the predetermined temperature is between 130° C. and 200° C., and the predetermined gap is between 0.5 mm and 2.0 mm.

4. The method of making the golf club shaft as claimed in claim 1, further comprising a step f) of placing the formed shaft body carrying the counterweight member in a vacuum machine at a predetermined vacuum level and a predetermined operating temperature to firmly bond the counterweight member on the formed shaft body.

* * * * *